US010923861B2

(12) United States Patent
Messuri et al.

(10) Patent No.: US 10,923,861 B2
(45) Date of Patent: Feb. 16, 2021

(54) ELECTROMAGNETIC SHIELD FOR AN ELECTRICAL TERMINAL WITH INTEGRAL SPRING CONTACT ARMS

(71) Applicant: Aptiv Technologies Limited, St. Michael (BB)

(72) Inventors: Michael D. Messuri, Canfield, OH (US); John R. Morello, Warren, OH (US); James M. Rainey, Warren, OH (US)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/555,245

(22) Filed: Aug. 29, 2019

(65) Prior Publication Data

US 2020/0127420 A1 Apr. 23, 2020

Related U.S. Application Data

(60) Provisional application No. 62/747,824, filed on Oct. 19, 2018.

(51) Int. Cl.
*H01R 13/6582* (2011.01)
*H01R 4/48* (2006.01)
(Continued)

(52) U.S. Cl.
CPC ..... *H01R 13/6582* (2013.01); *H01R 4/16* (2013.01); *H01R 4/48* (2013.01); *H01R 13/508* (2013.01); *H01R 13/635* (2013.01)

(58) Field of Classification Search
CPC ..... H01R 13/6583; H01R 13/6592; H01R 13/6582; H01R 4/16; H01R 4/48
(Continued)

(56) References Cited

U.S. PATENT DOCUMENTS 4,812,137 A * 3/1989 Wilson ..... H01R 13/6582 439/607.17
4,936,795 A * 6/1990 Kawai ..... H01R 13/655 439/607.19
(Continued)

FOREIGN PATENT DOCUMENTS

CN 102870280 A 1/2013
CN 203386995 U 1/2014
(Continued)

OTHER PUBLICATIONS

European Search Report for Application No. 19203501, European Patent Office, dated Jan. 16, 2020.
(Continued)

*Primary Examiner* — Abdullah A Riyami
*Assistant Examiner* — Marcus E Harcum
(74) *Attorney, Agent, or Firm* — Robert Myers; Billion & Armitage

(57) ABSTRACT

An electromagnetic terminal shield includes a shield body formed of sheet metal having a connector opening configured to receive a corresponding mating terminal shield and a cable opening configured to receive a wire cable. The terminal shield also includes a plurality of cantilevered spring arms integrally formed with the shield body having fixed ends attached to the connector opening and free ends disposed within a shield cavity defined by the shield body. A process for manufacturing the electromagnetic terminal shield is also presented.

18 Claims, 4 Drawing Sheets

(51) Int. Cl.
*H01R 13/635* (2006.01)
*H01R 13/508* (2006.01)
*H01R 4/16* (2006.01)

(58) Field of Classification Search
USPC ..... 439/748, 843
See application file for complete search history.

(56) References Cited

U.S. PATENT DOCUMENTS

| | | | | |
|---|---|---|---|---|
| 6,479,622 | B1 * | 11/2002 | Gross | C08G 75/045 528/376 |
| 7,097,505 | B1 * | 8/2006 | Shanahan | H01R 24/28 439/607.01 |
| 7,150,653 | B1 * | 12/2006 | Mason | H05K 9/0058 439/607.18 |
| 7,794,274 | B2 * | 9/2010 | Phillips, Jr. | H01R 13/187 439/578 |
| 9,004,946 | B2 * | 4/2015 | Hoeppner | H01R 13/53 439/607.41 |
| 9,362,631 | B2 | 6/2016 | Listing et al. | |
| 9,667,000 | B1 | 5/2017 | Morello et al. | |
| 9,762,001 | B2 | 9/2017 | Morello et al. | |
| 9,960,550 | B2 | 5/2018 | Ensley et al. | |
| 10,008,786 | B2 | 6/2018 | Brantingham | |
| 2002/0142636 | A1 * | 10/2002 | Murr | H01R 13/6582 439/108 |
| 2008/0233797 | A1 * | 9/2008 | Hsu | H01R 13/6594 439/607.01 |
| 2010/0035459 | A1 * | 2/2010 | Briant | H01R 13/6275 439/352 |
| 2016/0020541 | A1 * | 1/2016 | Takamura | H01R 13/2407 439/816 |
| 2016/0126654 | A1 * | 5/2016 | Hashiguchi | H01R 12/718 439/851 |
| 2017/0373444 | A1 * | 12/2017 | Hu | H01R 13/6582 |
| 2018/0054012 | A1 * | 2/2018 | Zhu | H01R 9/0512 |
| 2018/0164519 | A1 * | 6/2018 | Takai | H01R 12/714 |
| 2018/0375233 | A1 | 12/2018 | Morello et al. | |
| 2019/0067880 | A1 * | 2/2019 | Zhang | H01R 13/6594 |
| 2019/0199008 | A1 * | 6/2019 | Kanemura | H01R 13/4362 |
| 2019/0199013 | A1 * | 6/2019 | Kanemura | H01R 13/6581 |
| 2019/0288459 | A1 * | 9/2019 | Jin | H01R 13/426 |
| 2020/0119495 | A1 * | 4/2020 | Bredbeck | H01R 13/11 |

FOREIGN PATENT DOCUMENTS

| | | |
|---|---|---|
| CN | 108039598 A | 5/2018 |
| EP | 2843774 B1 | 5/2016 |

OTHER PUBLICATIONS

Chinese Search Report for CN Application No. 201910966622.2, dated Oct. 9, 2020, 8 pages.

* cited by examiner

ELECTROMAGNETIC SHIELD FOR AN ELECTRICAL TERMINAL WITH INTEGRAL SPRING CONTACT ARMS

CROSS-REFERENCE TO RELATED APPLICATION

This application claims the benefit under 35 U.S.C. § 119(e) of U.S. Provisional Patent Application No. 62/747,824 filed on Oct. 19, 2018, the entire disclosure of which is hereby incorporated by reference.

TECHNICAL FIELD OF THE INVENTION

The invention generally relates to an electromagnetic shield for an electrical terminal, particularly to an electromagnetic shield with spring contact arms that are integrally formed with the electromagnetic shield.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
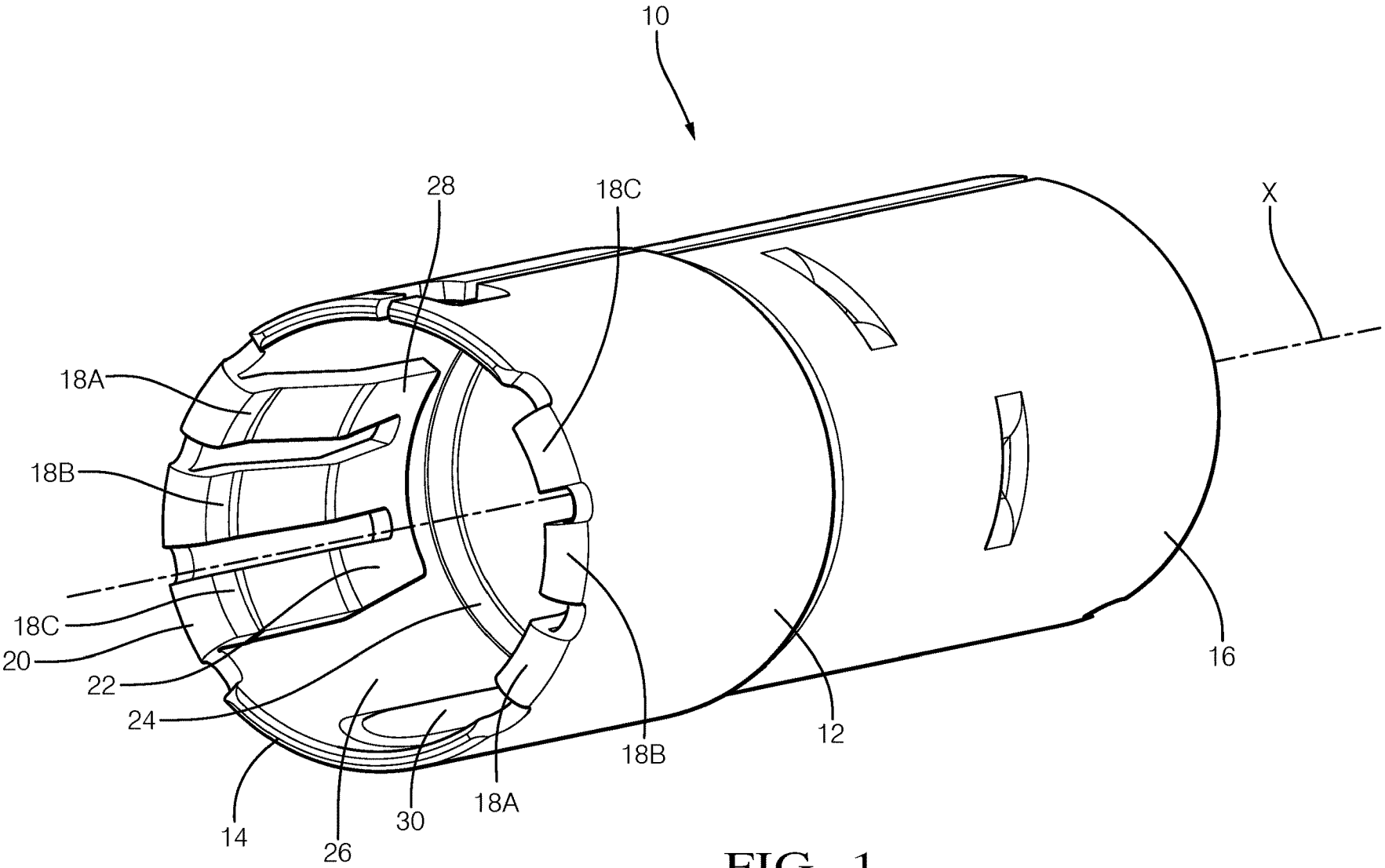
FIG. 1 is a perspective view of an electromagnetic terminal shield having integral spring contact arms, according to one embodiment of the invention.
Figure 2:
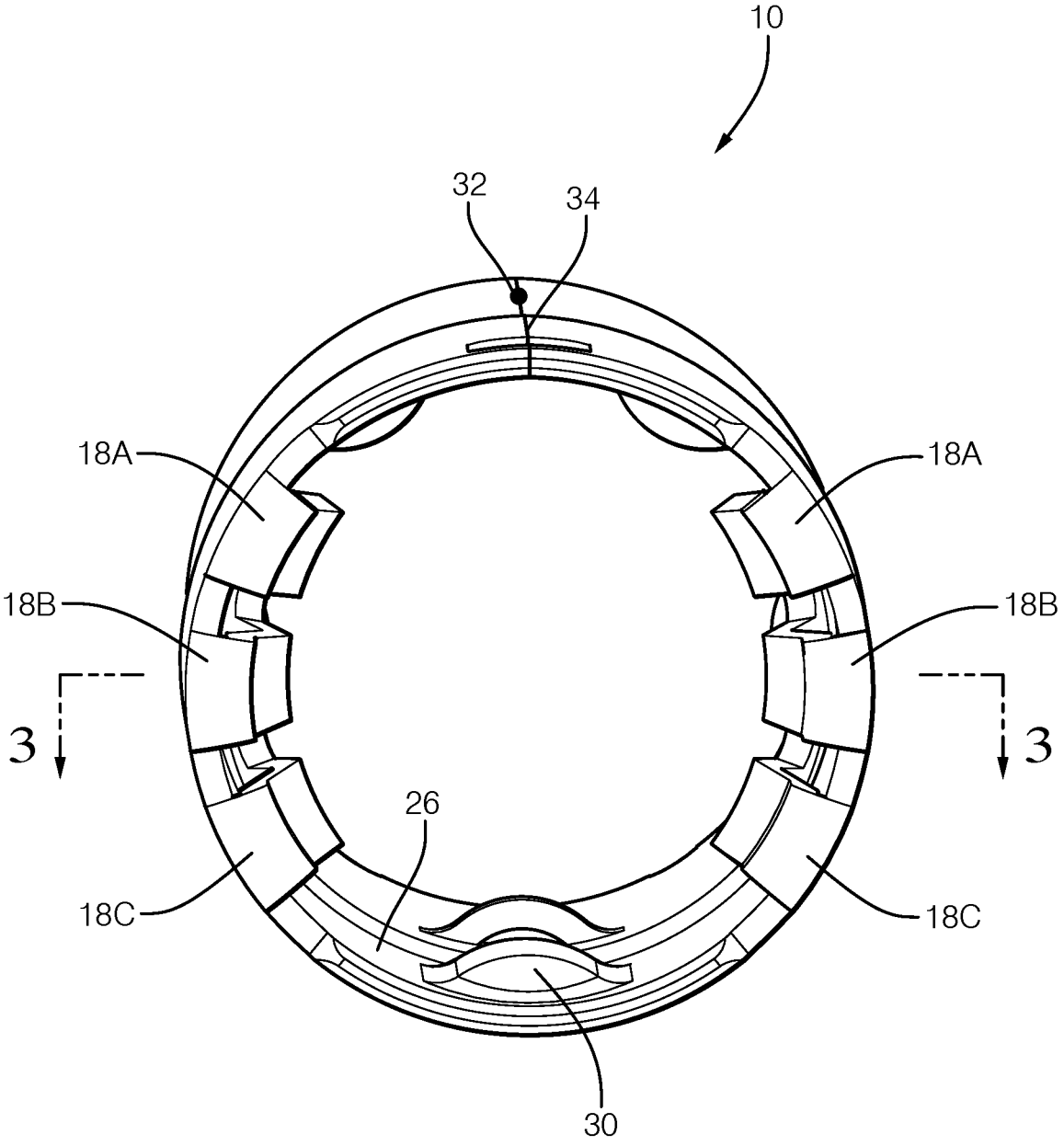
FIG. 2 is an end view of the electromagnetic terminal shield of FIG. 1, according to one embodiment of the invention.
Figure 3:
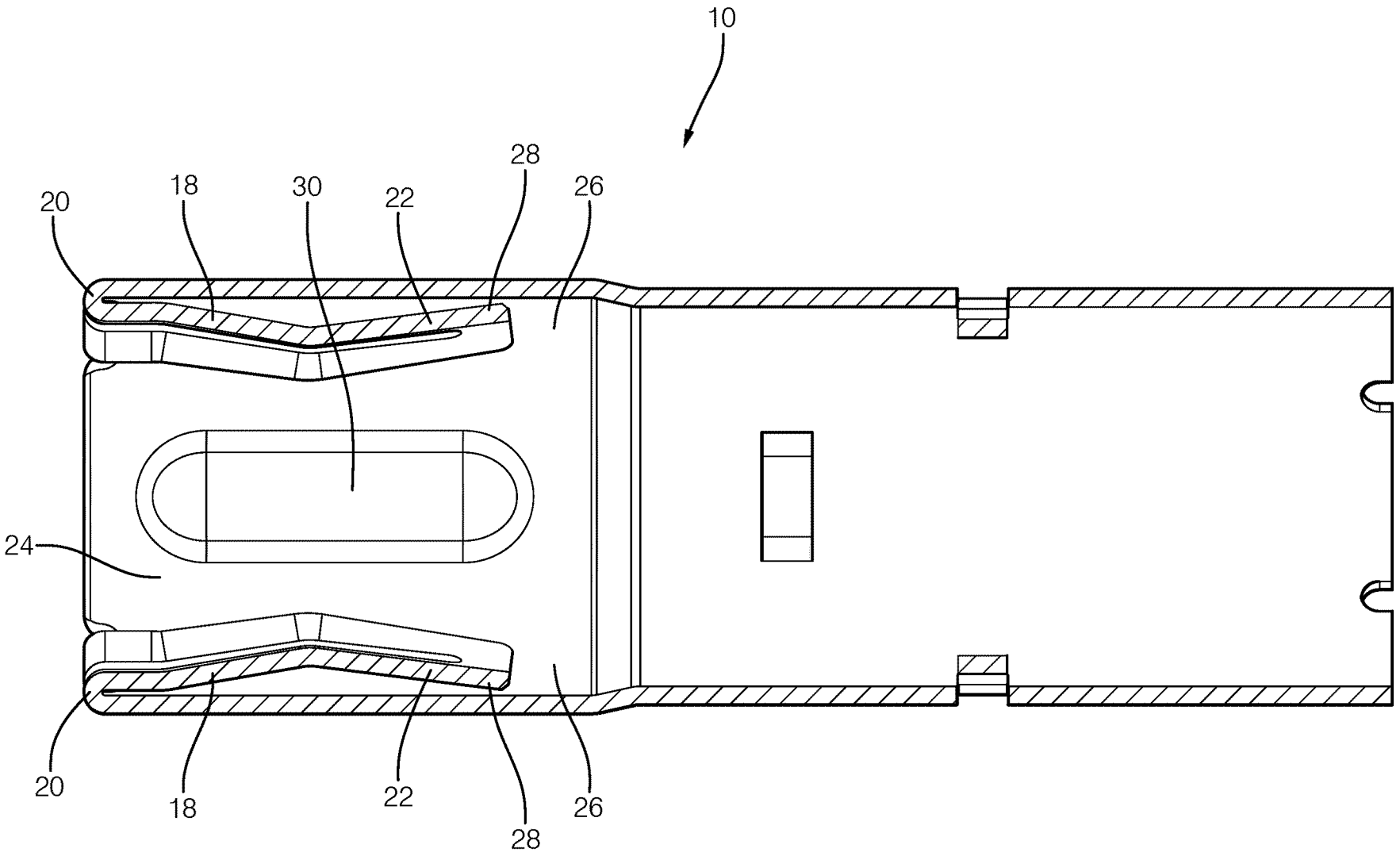
FIG. 3 is cross section side view of the electromagnetic terminal shield of FIG. 1, according to one embodiment of the invention.

FIGS. 1 through 3 illustrate an embodiment of an electromagnetic terminal shield, hereinafter referred to as the shield 10, that is configured to be connected, for example to a shield conductor of a shielded cable (not shown), and provide electromagnetic shielding to an electrical terminal (not shown) connected to an inner conductor of the shielded cable. The shield 10 is configured to receive a corresponding mating electromagnetic terminal shield (not shown) within. The shield 10 includes a shield body 12 that is formed from a planar sheet of metal, such as a tin pelted copper-based material. The shield body 12 has a connector opening 14 that is configured to receive the corresponding mating terminal shield and a cable opening 16 that is configured to receive the shielded wire cable. The shielded wire cable is preferably terminated by a ferrule (not shown) that is received within the cable opening 16. The shield 10 also includes a plurality of cantilevered spring arms 18 extending along a longitudinal axis X of the shield body 12 that is integrally formed with the shield body 12 and has fixed ends 20 that are attached to the connector opening 14 and free ends 22 that are disposed within a shield cavity 24 defined by the shield body 12.

As best shown in FIG. 3, each spring arm 18 in the plurality of cantilevered spring arms 18 is bent toward an inner surface 26 of the shield body 12 within the shield cavity 24. The free end 22 of each spring arm 18 in the plurality of cantilevered spring arms 18 is in contact with the inner surface 26 of the shield body 12 within the shield cavity 24.

As best illustrated in FIG. 1, the plurality of cantilevered spring arms 18 includes a first spring arm 18A, a second spring arm 18B generally parallel to the first spring arm 18A, and a third spring arm 18C generally parallel to the second spring arm 18B. The free ends 22 of the first, second and third spring arms 18A-18C are interconnected by a cross bar 28 that is in contact with the inner surface 26 of the shield body 12 within the shield cavity 24.

As best shown in FIG. 3, each spring arm 18 in the plurality of cantilevered spring arms 18 is opposite another spring arm 18 in the plurality of cantilevered spring arms 18.

As shown in FIGS. 1-3, the shield 10 further includes a longitudinal contact rib 30 that is embossed in the shield body 12 and projects from the inner surface 26 into the shield cavity 24.

Figure 4:
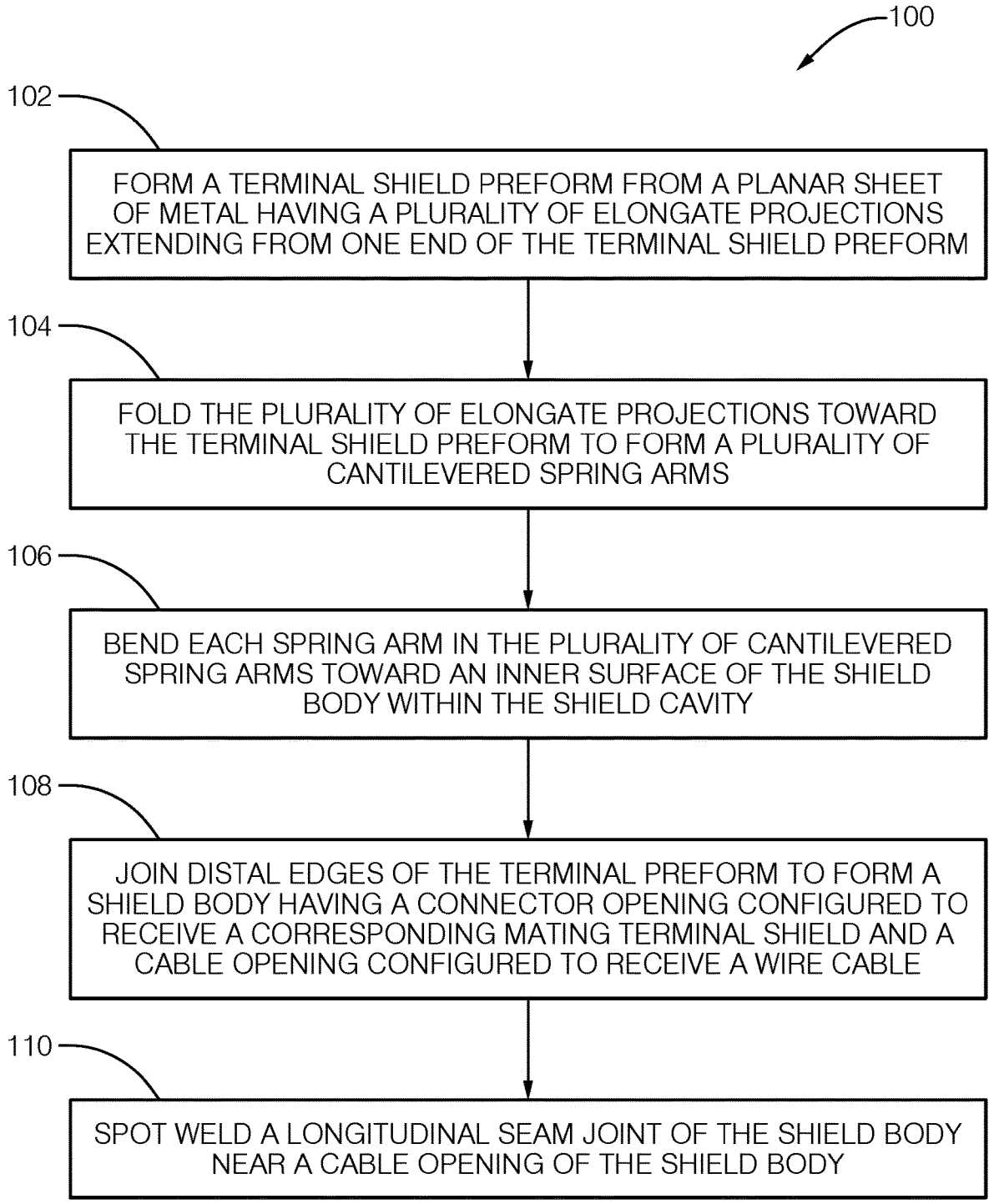
FIG. 4 is a flowchart of a process for manufacturing the electromagnetic terminal shield of FIG. 1, according to another embodiment of the invention.

FIG. 4 illustrates the steps of a process 100 for manufacturing the shield 10 described above. The process 100 includes the following steps:

STEP 102, FORM A TERMINAL SHIELD PREFORM, includes forming a terminal shield preform from a planar sheet of metal having a plurality of elongate projections extending longitudinally from one end of the terminal shield preform. The preform may be cut from the sheet metal using stamping, blanking, laser cutting, waterjet cutting, or any other sheet metal cutting process known to those skilled in the art;

STEP 104, FOLD ELONGATE PROJECTIONS TOWARD THE TERMINAL SHIELD PREFORM, includes folding the plurality of elongate projections toward the terminal shield preform to form a plurality of cantilevered spring arms 18. In the illustrated embodiment, the plurality of cantilevered spring arms 18 includes a first spring arm 18A, a second spring arm 18B generally parallel to the first spring arm 18A, and a third spring arm 18C generally parallel to the second spring arm 18B. The free ends 22 of the first, second and third spring arms 18A-18C are interconnected by a cross bar 28. Other embodiments may include a different configuration of the plurality of cantilevered spring arms 18;

STEP 106, BEND EACH SPRING ARM TOWARD AN INNER SURFACE, is an optional step that includes folding the plurality of elongate projections toward the terminal shield preform to form a plurality of cantilevered spring arms 18. STEP 106 is preferably performed prior to STEP 108; and STEP 108, JOIN DISTAL EDGES OF THE TERMINAL PREFORM TO FORM A SHIELD BODY, includes joining distal edges of the terminal preform by rolling the terminal preform to form a tubular shield body 12 having a connector opening 14 configured to receive a corresponding mating terminal shield and a cable opening 16 configured to receive a wire cable. The plurality of cantilevered spring arms 18 is integrally formed with the shield body 12 and has fixed ends 20 that are attached to the connector opening 14 and free ends 22 that are disposed within a shield cavity 24 defined by the shield body 12. Other embodiments may have a shield body that is rectangular, square, or any other desired shape.

STEP 110, SPOT WELD A LONGITUDINAL SEAM JOINT, includes spot welding a longitudinal seam joint 34 of the shield body 12 near a cable opening 16 of the shield body 12.

Accordingly, an electromagnetic terminal shield 10 and a process 100 of manufacturing the shield 10 is provided. The different spring rates of the first, second and third spring arms 18A-18C on each side of the shield 10 results in six independent and compliant contact points between the shield 10 and the corresponding mating terminal shield. The shield 10 provides low engage forces but high normal contact forces to provide easy connection and high connection performance. The spring arms 18 contact the shield body 12 at the front and near the rear of the shield body 12, thereby providing improves flow of energy in the shield 10 and optimal electromagnetic compliance (EMC) performance.

The shield 10 provides three different spring rates as the mating electromagnetic terminal shield is engaged with the shield 10. The three spring rates are provided by 1) a cantilevered spring arm 18, 2) a spring arm 18 forming a simply supported beam once the free end 22 of the spring arm 18 engages the inner surface 26 of the shield body 12, and 3) the radial spring of the shield body 12 itself. As the mating electromagnetic terminal shield is inserted into the shield body 12, a first spring rate is provided when the mating electromagnetic terminal shield engages the spring arm 18 when the free end 22 is away from the inside surface of the shield 10. This provides a lower initial engagement force. A second spring rate is provided when the free end 22 of the spring arm 18 engages the inner surface 26 it becomes a simply supported beam. This provides a higher normal force once the initial alignment is mostly completed and the engagement force is mainly due to friction. The third spring rate is provided by the radial hoop shape of the shield 10 itself and the axial location of a spot weld 32 on the seam joint 34 of the shield body 12 near the cable opening 16. This allows for greater tolerance in the connector opening 14. A smaller connector opening 14 provides more interference with the mating electromagnetic terminal shield and a results in a higher engagement force. Before the engagement force gets too high, the shield body 12 will flex and the seam joint 34 will open instead.

The contact rib 30 provides stabilization of the shield 10 and improved normal force. Forming the spring arms 18 by folding projection back into the shield cavity 24 of the shield body 12 eliminates openings in the shield body 12 that improves EMC performance and increases contact protection.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electromagnetic terminal shield, comprising:

a shield body formed of sheet metal having a connector opening configured to receive a corresponding mating terminal shield and a cable opening configured to receive a wire cable; and a plurality of cantilevered spring arms integrally formed with the shield body having fixed ends attached to the connector opening and free ends disposed within a shield cavity defined by the shield body, the free ends interconnected by a cross bar, wherein the plurality of cantilevered spring arms includes a first spring arm, a second spring arm generally parallel to the first spring arm, and a third spring arm generally parallel to the second spring arm.

2. The electromagnetic terminal shield according to claim 1, wherein each spring arm in the plurality of cantilevered spring arms is bent toward an inner surface of the shield body within the shield cavity.

3. The electromagnetic terminal shield according to claim 1, wherein each spring arm in the plurality of cantilevered spring arms has a free end that is in contact with the inner surface of the shield body within the shield cavity.

4. The electromagnetic terminal shield according to claim 1, wherein the plurality of cantilevered spring arms is a first plurality of cantilevered spring arms and wherein the electromagnetic terminal shield further comprises a second plurality of cantilevered spring arms located opposite the first plurality of cantilevered spring arms within the shield cavity.

5. The electromagnetic terminal shield according to claim 1, wherein the shield body defines a longitudinal seam joint and wherein the seam joint is spot welded near a cable opening.

6. A process for manufacturing an electromagnetic terminal shield, comprising the steps of:

forming a terminal shield preform from a planar sheet of metal having a plurality of elongate projections extending from one end of the terminal shield preform;

folding the plurality of elongate projections toward the terminal shield preform to form a plurality of cantilevered spring arms;

joining distal edges of the terminal preform to form a shield body having a connector opening configured to receive a corresponding mating terminal shield and a cable opening configured to receive a wire cable, wherein the plurality of cantilevered spring arms is integrally formed with the shield body having fixed ends attached to the connector opening and free ends interconnected by a cross bar and disposed within a shield cavity defined by the shield body, wherein the plurality of cantilevered spring arms includes a first spring arm, a second spring arm generally parallel to the first spring arm, and a third spring arm generally parallel to the second spring arm.

7. The process according to claim 6, wherein the process further includes the step of bending each spring arm in the plurality of cantilevered spring arms toward an inner surface of the shield body within the shield cavity.

8. The process according to claim 6, wherein the cross bar is in contact with the inner surface of the shield body within the shield cavity.

9. The process according to claim 6, wherein the plurality of cantilevered spring arms is a first plurality of cantilevered spring arms and wherein the electromagnetic terminal shield further comprises a second plurality of cantilevered spring arms located opposite the first plurality of cantilevered spring arms within the shield cavity.

10. The process according to claim 6, wherein the process further includes the step of spot welding a longitudinal seam joint of the shield body near a cable opening of the shield body.

11. An electromagnetic terminal shield manufactured by a process, comprising the steps of:

forming a terminal shield preform from a planar sheet of metal having a plurality of elongate projections extending from one end of the terminal shield preform;

folding the plurality of elongate projections toward the terminal shield preform to form a plurality of cantilevered spring arms;

joining distal edges of the terminal preform to form a shield body having a connector opening configured to receive a corresponding mating terminal shield and a cable opening configured to receive a wire cable, wherein the plurality of cantilevered spring arms is integrally formed with the shield body having fixed ends attached to the connector opening and free ends interconnected by a cross bar and disposed within a shield cavity defined by the shield body, wherein the plurality of cantilevered spring arms includes a first spring arm, a second spring arm generally parallel to the first spring arm, and a third spring arm generally parallel to the second spring arm.

12. The electromagnetic terminal shield according to claim 11, wherein the process further includes the step of bending each spring arm in the plurality of cantilevered spring arms toward an inner surface of the shield body within the shield cavity.

13. The electromagnetic terminal shield according to claim 11, wherein the cross bar is in contact with the inner surface of the shield body within the shield cavity.

14. The electromagnetic terminal shield according to claim 11, wherein the plurality of cantilevered spring arms is a first plurality of cantilevered spring arms and wherein the electromagnetic terminal shield further comprises a second plurality of cantilevered spring arms located opposite the first plurality of cantilevered spring arms within the shield cavity.

15. The electromagnetic terminal shield according to claim 11, wherein the process further includes the step of spot welding a longitudinal seam joint of the shield body near a cable opening of the shield body.

16. The electromagnetic terminal shield according to claim 1, wherein the cross bar is in contact with the inner surface of the shield body within the shield cavity.

17. The electromagnetic terminal shield according to claim 6, wherein the cross bar is in contact with the inner surface of the shield body within the shield cavity.

18. The electromagnetic terminal shield according to claim 11, wherein the cross bar is in contact with the inner surface of the shield body within the shield cavity.

* * * * *